United States Patent [19]

Hyne et al.

[11] Patent Number: 4,815,770

[45] Date of Patent: Mar. 28, 1989

[54] SUBSEA CASING HANGER PACKOFF ASSEMBLY

[75] Inventors: Joseph H. Hyne, Houston; Matthew K. Cyvas, Kingwood; David D. Long, Houston, all of Tex.

[73] Assignee: Cameron Iron Works USA, Inc., Houston, Tex.

[21] Appl. No.: 93,574

[22] Filed: Sep. 4, 1987

[51] Int. Cl.[4] ..... F16L 21/04

[52] U.S. Cl. ..... 285/140; 285/338; 285/351; 285/915; 285/917; 277/235 R

[58] Field of Search ..... 285/338, 162, 196, 917, 285/351, 915, 140, 141, 142, 143, 18; 277/235 R; 168/88, 87

[56] References Cited

U.S. PATENT DOCUMENTS

| | | | |
|---|---|---|---|
| 3,561,527 | 2/1971 | Nelson . | |
| 3,797,864 | 3/1974 | Hynes et al. . | |
| 3,809,158 | 5/1974 | Bonds et al. | 285/18 |
| 3,837,684 | 9/1974 | Hynes . | |
| 4,324,422 | 4/1982 | Rains et al. | 285/140 |
| 4,496,162 | 1/1985 | McEver et al. . | |
| 4,521,040 | 6/1985 | Slyker et al. . | |
| 4,595,063 | 6/1986 | Jennings . | |
| 4,615,544 | 10/1986 | Baujh . | |
| 4,634,152 | 1/1987 | Pettit | 285/140 |
| 4,714,111 | 12/1987 | Brammer | 285/141 X |
| 4,719,971 | 1/1988 | Owens | 285/140 |
| 4,743,033 | 5/1988 | Guess | 277/235 R |

OTHER PUBLICATIONS

Application S.N. 044,411, 4/30/87.
Application S.N. 044,416, 4/30/87.

*Primary Examiner*—Dave W. Arola
*Attorney, Agent, or Firm*—Vinson & Elkins

[57] ABSTRACT

A packoff assembly for sealing an annulus between an inner tubular member and an outer tubular member including a sealing means rotatably connected to a packing nut. The sealing means includes an upper actuation ring rotatably retained on the packing nut. A sealing member having a ring-like metal body is rotatably mounted on the upper actuation ring with a roller ball connection which permits limited relative axial movement between the upper actuation ring and the sealing member. A lower actuation ring is rotatably mounted on the body of the sealing member by another roller ball connection which permits limited relative axial movement between the lower actuation ring and the body of the sealing member. The metal body of the sealing member includes a pair of frustoconical-shaped outer seal lips and a pair of frustoconical-shaped inner seal lips. An elastomeric seal ring is disposed on the body of the sealing member between each pair of metal seal lips. The upper seal lips of each pair flare upwardly, and the lower seal lips of each pair flare downwardly. The faces of the upper and lower actuation rings which oppose the respective faces of the adjacent metal seal lips are frustonconical in shape and are sloped in directions opposite to those of the seal lips. There is a void space between such faces of the actuation rings and their respective adjacent metal seal lips.

48 Claims, 4 Drawing Sheets

SUBSEA CASING HANGER PACKOFF ASSEMBLY

BACKGROUND OF THE INVENTION

The present invention is directed generally to seals, and more particularly, to a packoff assembly for sealing an annulus between an inner tubular member and an outer tubular member. The present invention is especially useful as a casing hanger packoff assembly for an underwater oil or gas well which seals the annular space between a casing hanger and the housing of a subsea wellhead.

In the past, subsea wellhead systems having working pressures of up to 15,000 psi have been known and used in the drilling of underwater wells for the production of oil and gas. An example of one subsea wellhead system having such a 15,000 psi working pressure utilizes a separately installable landing shoulder insert or support member for multiple concentric casing strings and hangers in order to allow full bore access, without underreaming, below the wellhead housing for a standard 17½ inch drill bit prior to installation of the multiple concentric casing strings. Such a system is disclosed, for example, in U.S. Pat. No. 4,615,544, issued Oct. 7, 1986, which is incorporated in its entirety herein by reference. The multiple concentric casing strings, or surface casing, may be, for example, 13⅜ inch, 9⅝ inch, and 7 inch strings, all supported on the landing shoulder insert attached to the wellhead housing and concentrically disposed within a conductor casing string, typically a 20 inch string welded to the bottom of the wellhead housing. Each of the surface casing strings is suspended from a hanger, and the hangers are stacked one upon the other, with the uppermost hanger suspending the smallest diameter casing string and the lowermost hanger suspending the largest diameter casing string.

One major problem that arises in 15,000 psi working pressure subsea wellhead systems is to provide a sealing means between the casing hangers and wellhead which will withstand and contain the working pressure. It is an object of the present invention to provide for such a sealing means that is simple, easy to manufacture, easy to install and retrieve, and reliable. It is another object of the present invention to provide for such a sealing means that has minimal requirements concerning externally applied loading force to set the seal. It is yet another object of the present invention to provide for such a sealing means that will be pressure-energized in service up to full working pressure after application of the minimal external loading force. It is also an object of the present invention to provide a sealing means with combined metal and elastomer sealing members to enable the operator to initially load the sealing means only to a point of establishing an elastomer seal with metal backup rings and thereafter allowing pressure-energization, which may or may not also establish a metal-to-metal seal, depending upon the magnitude of the load experienced in service, or to initially load the sealing means to a point of establishing an elastomer and a metal-to-metal seal and thereafter allowing additional pressure-energization of both the elastomer and the metal-to-metal seals. It is yet another object of the present invention to provide for such a sealing means having improved self-centering characteristics in instances where the casing hanger may have landed slightly off center in the wellhead housing. Still another object of the present invention is to provide for such a sealing means wherein its components may be rotated with respect to one another when required, such as by a failure of the bearing between the packing nut member and the sealing means. It is a further object of this invention to provide a sealing means having a continuous metal link therethrough to provide high tensile strength capacity for those times when it may be necessary to retrieve the sealing means. It is also an object of the present invention to provide a sealing means with the ability for the seal compression to continue after either the inside or outside seal member has reached its maximum ability to compress and the other seal member requires some additional compression.

The sealing means of the present invention accomplishes the above objectives and can be used to reliably seal the annular area between a casing hanger and subsea wellhead housing when the sealing means is energized and experiences a working pressure from above or below of up to 15,000 psi. The sealing means can be energized through the application of less than about 15,000 ft.-lbs. of torque through the drill string, or the equivalent thereof in the case of hydraulic and/or weight setting, and may even be energized with as little as about 1,500 ft.-lbs. of torque or the equivalent thereof, followed by additional pressure-energization in service. A casing hanger packoff assembly of the present invention is adapted to be disposed, for example, on each surface casing hanger of the subsea wellhead system disclosed in U.S. Pat. No. 4,615,544 and to seal the annular space between such hanger and the subsea wellhead housing.

SUMMARY OF THE INVENTION

The present invention provides a packoff assembly for sealing an annulus between an inner tubular member and an outer tubular member, such as between a casing hanger and the housing of a subsea wellhead. The packoff assembly includes a sealing means rotatably connected to a packing nut. The packing nut is threadingly or otherwise mounted on the inner tubular member, e.g., the casing hanger.

The sealing means of the present invention includes an upper actuation ring which is retained on the packing nut by the rotatable connection referred to above. A sealing member having an integral, continuous ring-like metal body is rotatably mounted on the upper actuation ring by means of a plurality of roller balls disposed in a race between the exterior wall of the body of the sealing member and the wall of a longitudinally axially extending blind slot in the lower end of the upper actuation ring in which the body of the sealing member is received. The portion of the ball race in the blind slot is elongated and permits limited relative axial movement between the upper actuation ring and the sealing member. A lower actuation ring is rotatably mounted on the body of the sealing member by a plurality of roller balls in a race like that between the upper actuation ring and the sealing member body, so that limited relative axial movement between the lower actuation ring and the body of the sealing member is permitted as well. The lower portion of the lower actuation ring may include a camming portion to actuate an expandable lock ring disposed, for example, on the inner tubular member, into engagement with a groove which may be provided in the wall of the outer tubular member in order to lock down the inner member within the outer member.

The metal body of the sealing member includes a pair of frustoconical-shaped outer seal lips and a pair of frustoconical-shaped inner seal lips. An outer elastomeric seal ring is disposed on the body of the sealing member between the outer metal seal lips, and an inner elastomeric seal ring is disposed on the body of the sealing member between the inner metal seal lips. The upper seal lips of each pair flare upwardly, and the lower seal lips of each pair flare downwardly. The faces of the upper and lower actuation rings which oppose the respective faces of the adjacent metal seal lips are frustoconical in shape and are sloped in directions opposite to those of the seal lips. There is a void space between such faces of the actuation rings and their respective adjacent metal seal lips.

To energize the sealing means of the present invention, axial thrust is applied to the upper actuation ring. After the expandable lock ring on the inner tubular member, if any, is actuated, the upper actuation ring moves toward the lower actuation ring and the sealing member is compressed therebetween. The metal seal lips of each pair are moved toward one another by the adjacent faces of the actuation rings and compress the respective elastomeric seal rings between them. The outer elastomeric seal ring expands into sealing engagement with the bore wall of the outer tubular member, and the inner elastomeric seal ring contracts into sealing engagement with the outer wall of the inner tubular member. Additional axial loading on the sealing means causes the metal seal lips to bend or pivot into coining, metal-to-metal sealing engagement with the adjacent walls of the tubular members.

BRIEF DESCRIPTION OF THE DRAWINGS

For a detailed description of the preferred embodiment of the present invention, reference will now be made to the accompanying drawings wherein.

DETAILED DESCRIPTION OF THE PREFERRED EMBODIMENT

Figure 1:
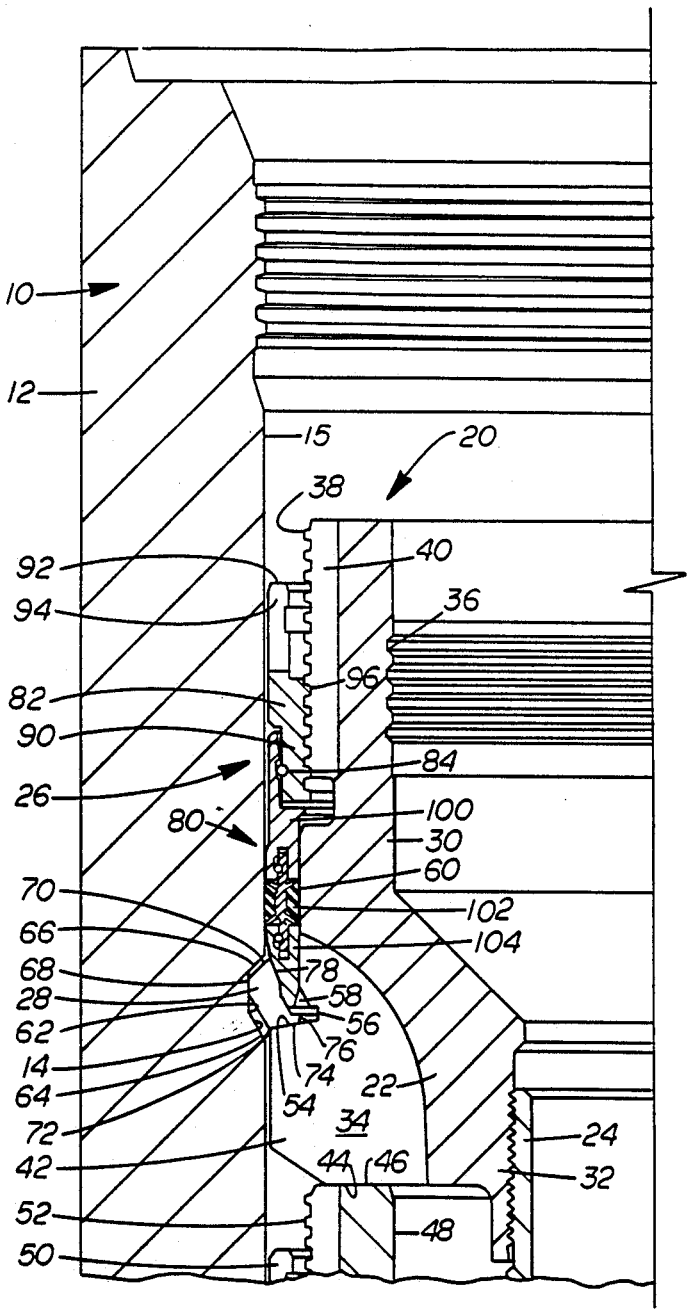
FIG. 1 is a fragmentary, vertical or longitudinal cross-sectional view of the preferred embodiment of the casing hanger packoff assembly of the present invention disposed on a casing hanger, in this case the uppermost casing hanger, in an underwater wellhead and after actuation of an expandable lock ring but prior to energization for sealing the annular space between the casing hanger and the wellhead housing.
Figure 2:
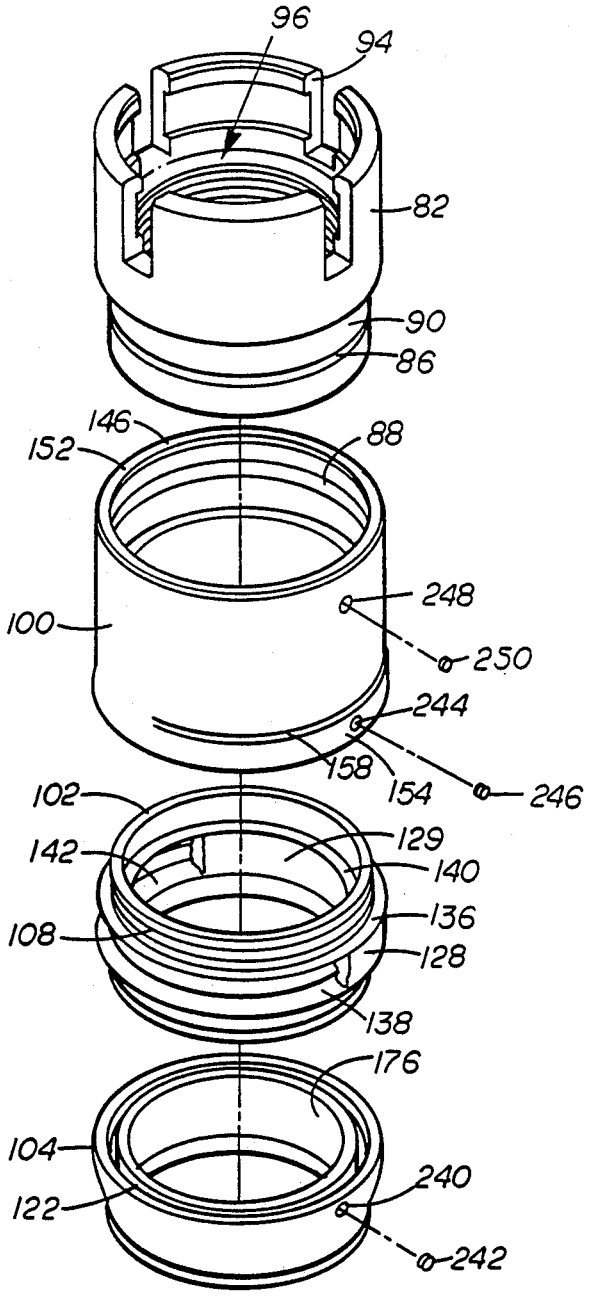
FIG. 2 is an exploded view of the casing hanger packoff assembly of FIG. 1.

Prior to describing the preferred embodiment of this invention in detail, reference is made generally to FIG. 1 and FIGS. 2B, 2C, 5A, 5B, and 5C of U.S. Pat. No. 4,615,544 for a disclosure of the general environment of the casing hanger packoff assembly of the present invention. Although the present invention may be used in a variety of environments, FIG. 1 of U.S. Pat. No. 4,615,544 is a diagrammatic illustration of a typical installation in which the casing hanger packoff assembly of the present invention will be especially useful, including a series of concentric surface casing strings in a wellhead disposed on the ocean floor of an offshore well. As represented therein, a well bore is drilled into the sea floor below a body of water from, for example, a drilling vessel floating at the surface of the water. A base structure or guide base, a conductor casing, a wellhead, a blowout preventer stack with pressure control equipment, and a marine riser are lowered from the floating drilling vessel and installed on the sea floor. The conductor casing may be driven or jetted into the sea floor until the wellhead rests near the sea floor or, alternately, a bore hole may be drilled for the insertion of the conductor casing. A guide base is secured about the upper end of the conductor casing on the sea floor, and the conductor casing is anchored within the bore hole by a column of cement about a substantial portion of its length. A blowout preventer stack is releasably connected through a suitable connection to the wellhead and includes one or more blowout preventers. Such blowout preventers include a number of sealing pipe rams adapted to be actuated to and from the blowout preventer housing into and out of sealing engagement with a tubular member, such as drill pipe, extending through the blowout preventer stack, as is well known. A marine riser pipe extends from the top of the blowout preventer stack to the floating vessel.

The blowout preventer stack includes "choke and kill" lines extending to the surface. The choke and kill lines are used, for example, to test the pipe rams of the blowout preventers. In testing the rams, a test plug is run into the well through the riser to seal off the well at the wellhead. The rams are activated and closed, and pressure is then applied through the kill line with a valve on the choke line closed to test the pipe rams.

Drilling apparatus, including drill pipe with a standard 17½ inch drill bit, is lowered through the riser and conductor casing to drill a deeper hole in the ocean bottom for the first surface casing string, which may be, for example, a 13⅜ inch string. A surface casing hanger for the first surface casing string is lowered through the riser with the surface casing string suspended therefrom until the hanger lands in the wellhead. The casing hanger is locked down in the wellhead housing and the packoff assembly of the present invention is set according to the principles and practices set forth herein. Other interior casing strings with their respective hangers are subsequently landed and suspended in the wellhead housing and sealed with respect thereto, also according to the principles and practices set forth herein.

Now referring to the drawings directed to the present invention and, more particularly, to FIG. 1 hereof, a subsea wellhead includes a housing 10. The housing 10 may have any of a plurality of known exterior configurations. The housing 10 extends from an upper portion 12 down into the well to a lower portion (not shown). A wellhead connector (not shown) is attached to the exterior of the upper end of the upper portion 12 of housing 10, for example by a clamp, collet fingers, or other means, for attaching blowout preventers or other well apparatus to the top of the wellhead housing.

Housing 10 contains therein an uppermost casing assembly 20 which includes a casing hanger 22 for suspending a casing 24, a packoff assembly 26 of the present invention, and an expandable lock ring 28. As shown in FIG. 1, the packoff assembly has actuated the expandable lock ring 28 but the sealing means has not yet been energized. On the inner diametral surface of upper portion 12 of housing 10 are disposed a plurality of longitudinally spaced apart circumferential grooves, the uppermost of which is shown at 14. Groove 14 is provided for locking hanger 22 to wellhead housing 10 by means of the expandable lock ring 28. Lock ring 28 is actuated and moved into groove 14 when packoff assembly 26 is moved downwardly to energize its seal members, as is more fully set out below.

Casing hanger 22 has a generally tubular body 30 which includes a lower threaded box end 3 threadingly engaging the upper joint of casing string 24 for suspending string 24 within the borehole. Hanger 22 also includes an outwardly projecting shoulder 34 on which is disposed the expandable lock ring 28, and a plurality of annular grooves 36 in the inner periphery of body 30 adapted for connection with a running tool (not shown) for running casing assembly 20 into the well. Threads 38, which may be, for example, Acme threads, are provided from the top down along a substantial length of the exterior of tubular body 30 for engagement with packoff assembly 26. A plurality of upper and lower flutes or circulation ports 40, 42 are provided through hanger body 30 to permit fluid flow, such as for cementing operations, around casing hanger 22. Lower flutes 42 provide fluid passageways through radially outwardly extending shoulder 34 and upper flutes 40 provide fluid passageways through the upper threaded end of tubular body 30 to pass fluids around packoff assembly 26.

The lower face 44 of shoulder 34 of hanger 22 between flutes 42 comprises a substantially flat surface which rests atop the upper terminal end 46 of another surface casing hanger 48 of the series of stacked hangers referred to above. Hanger 48 may be, for example, a hanger for a 9⅝ inch casing string. Another packoff assembly 50 of the present invention is disposed on the threaded exterior upper portion 52 of hanger 48. Hanger 48 typically will rest atop a still further casing hanger, such as a 13⅜ inch hanger (not shown), which in turn will typically rest on a support shoulder (not shown) in the wellhead housing. As stated previously, the support shoulder may be provided by a separately installable landing shoulder or insert member as disclosed in U.S. Pat. No. 4,615,544. The 13⅜ inch hanger will also be provided with a packoff assembly of the present invention, so that all the surface casing hangers may be sealed against the bore wall 15 of wellhead housing 10.

Shoulder 34 of hanger 22 has an upwardly facing, downwardly and outwardly tapering conical cam surface 54 with an annular relief groove 56 extending upwardly at its radially inner extremity. An annular chamber 58 extends from the upper end of groove 56 to an annular vertical sealing surface 60. Shoulder 34 is positioned below annular lock groove 14 in wellhead housing 10 after hanger 22 is landed in the wellhead. Cam surface 54 has its lower annular edge terminating just above the lower terminus of groove 14.

Expandable lock ring 28 is disposed on shoulder 34 of hanger 22. Ring 28 may be a split ring which is adapted to be expanded into groove 14 for engagement with wellhead housing 10 to hold and lock down hanger 22 within the wellhead. Wellhead groove 14 has a vertical base 62 with an upwardly facing, downwardly and inwardly tapering lower wall 64 and a downwardly facing, upwardly and inwardly tapering upper wall 66. Ring 28 has a vertical, radially outermost surface 68 and adjacent upper and lower conical surfaces 70, 72, respectively, shaped correlatively to surfaces 66, 64, respectively, of groove 14 whereby upon expansion of ring 28 the vertical surface 68 of ring 28 engages the vertical base 62 of groove 14. Lock ring 28 also includes a downwardly facing conical lower camming face 74 slidingly engaging upwardly facing camming surface 54 of shoulder 34, an inwardly projecting annular ridge 76 received by annular relief groove 56 in the retracted position, and an upwardly and inwardly facing camming head 78 adapted for camming engagement with packoff assembly 26. Projecting annular ridge 76 is received within groove 56 of casing hanger 22 to prevent lock ring 28 from being pulled out of groove 56 as hanger 22 is run into the well, for example when lock ring 28 passes through any of several narrow diameters, such as in the blowout preventers, during the running in operation.

Packoff assembly 26 includes a sealing means 80 rotatably mounted on a packing nut 82 by a plurality of steel roller balls 84 disposed in an annular race (see FIGS. 3 and 4) defined by a groove 86 in the exterior periphery of packing nut 82 and an elongate, juxtaposed groove 88 in the interior periphery of the sealing means 80. The rotatable connection between packing nut 82 and sealing means 80 permits a full 360° rotation and limited longitudinal axial movement of sealing means 80 with respect to packing nut 82 due to the elongate configuration of groove 88. Packing nut 82 has a ring-like body with a lower pin end 90 and a castellated upper end 92 with a plurality of circumferentially spaced, upwardly projecting stops 94. The inner diametral surface of packing nut 82 includes threads 96 threadingly engaging the external threads 38 of casing hanger body 30.

Figure 3:
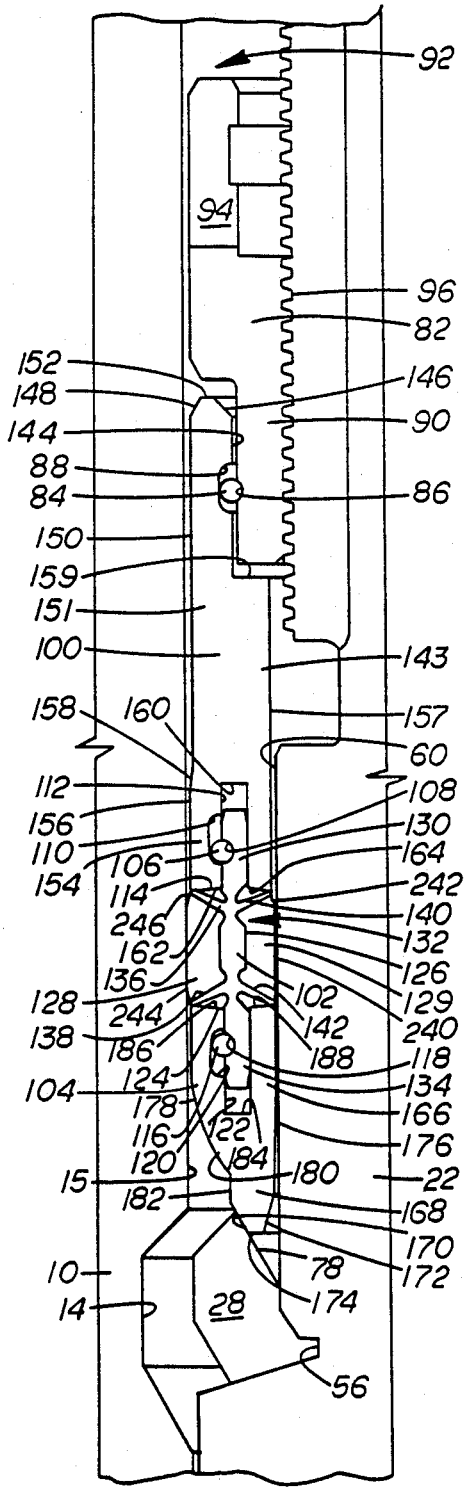
FIG. 3 is a fragmentary, vertical or longitudinal cross-sectional view of the casing hanger packoff assembly of the present invention disposed on the casing hanger in the wellhead of FIG. 1, prior to actuation of the expandable lock ring by the packoff assembly which locks down the casing hanger in the wellhead housing and prior to energization of the sealing member of the packoff assembly.
Figure 4:
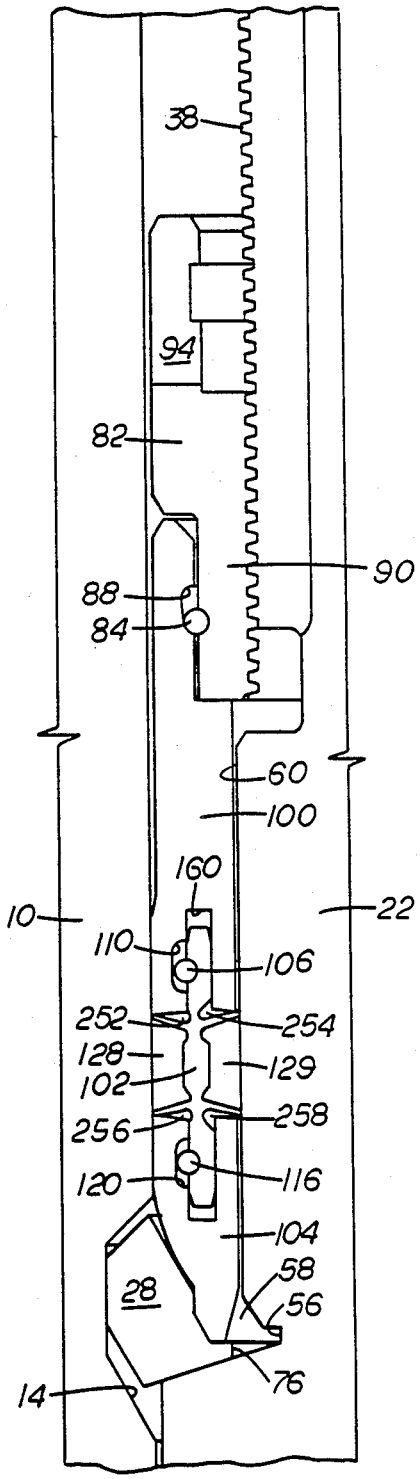
FIG. 4 is a fragmentary, vertical or longitudinal cross-sectional view similar to FIG. 3, but subsequent to actuation of the lock ring and energization of the sealing member of the packoff assembly.

Sealing means 80 includes an upper actuation ring 100 which is rotatably mounted on packing nut 82 by steel balls 84, a sealing member 102 rotatably mounted on upper actuation ring 100, and a lower actuation ring 104 rotatably mounted on sealing member 102. As shown in FIGS. 3 and 4, sealing member 102 is retained on upper actuation ring 100 by a 360° rotatable connection substantially similar to that between packing nut 82 and upper actuation ring 100, including a plurality of steel roller balls 106 disposed in an annular race defined by a groove 108 in the upper exterior periphery of sealing member 102 and an elongate, juxtaposed groove 110 in the radially outermost wall of an annular blind slot 112 extending longitudinally axially upward from the lower end 114 of upper actuation ring 100. Limited longitudinal axial movement of sealing member 102 with respect to upper actuation ring 100 is permitted due to the elongate configuration of groove 110. Lower actuation ring 104 is retained on sealing member 102 by a 360° rotatable connection like that between sealing member 102 and upper actuation ring 100, including a plurality of steel roller balls 116 disposed in an annular race defined by a groove 118 in the lower exterior periphery of sealing member 102 and an elongate, juxtaposed groove 120 in the radially outermost wall of an annular blind slot 122 extending longitudinally axially downward from the upper end 124 of lower actuation ring 104. Limited longitudinal axial movement of sealing member 102 with respect to lower actuation ring 104 is permitted due to the elongate configuration of groove 120. It is to be noted that the ball races 108, 110 and 118, 120 may be on the interior periphery of sealing member 102 and in the radially innermost walls of blind slots 112, 122, without affecting the performance of sealing means 80. Thus, both upper and lower actuation rings 100, 104 can rotate a full 360° with respect to sealing member 102, and both actuation rings 100, 104 can move longitudinally axially to a limited extent with respect to sealing member 102. The maximum extent to which such limited axial movement is permitted may depend in part upon the axial lengths of grooves 110, 120, the sizes of balls 106, 116, the axial depths of slots 112, 122, and the extent of the body of sealing member 102 in slot 112 above balls 106 and in slot 122 below balls 116, but it should also be noted that the actual movement experienced in service will probably be, in most cases, less than the maximum, as illustrated in FIG. 4, and will be a function of the degree and manner of deformation of sealing member 102 occurring in the energization process. The latter depend, in turn, upon such factors as the geometry and the mechanical properties of the deforming parts of the sealing member 102 and their fit with the opposing faces of the actuation rings, the setting load applied, and the pressure encountered in service.

With reference to FIGS. 3 and 4, member 102 has a ring-like body 126 and includes outer and inner elastomeric seal rings 128, 129 disposed thereon for providing a resilient seal between the internal bore wall 15 of wellhead housing 10 and external sealing surface 60 of casing hanger 22. Ring-like body 126 is a continuous and integral metal member and includes an upper connecting portion 130, an intermediate seal portion 132, and a lower connecting portion 134. Intermediate seal portion 132 also includes upper and lower outer seal lips 136, 138 for moving annular elastomeric seal ring 128 into sealing engagement with bore wall 15 and for creating metal-to-metal seals against such bore wall upon energization of sealing means 80. Intermediate seal portion 132 further includes upper and lower inner seal lips 140, 142 for moving annular elastomeric seal ring 129 into sealing engagement with sealing surface 60 and for creating metal-to-metal seals against surface 60 upon energization of sealing means 80.

Upper actuation ring 100 includes a generally tubular cylindrical body 143 having an upper counterbore 144 therein which receives pin end 90 of packing nut 82. Around the interior periphery of the upper end of actuation ring 100 and extending to counterbore 144 there is disposed a frustoconical surface 146. Another frustoconical surface 148, having a smaller cone angle than surface 146, is disposed around the exterior periphery of the upper end of ring 100 and extends to the smooth cylindrical outer wall surface 150 of an upper reduced outer diameter portion 151 of ring 100. A flat annular surface 152 comprises the upper terminal end of ring 100 and extends between surfaces 146, 148. Below reduced outer diameter portion 151, body 143 of ring 100 has an increased outer diameter portion 154 with a smooth cylindrical outer wall surface 156. A smooth frustoconical outer wall surface 158 extends between surfaces 150, 156. Increased outer diameter portion 154 extends downwardly to the lower terminal end 114 of ring 100. The outer diameters of cylindrical walls 150, 158, 156 are less than the internal diameter of bore 15 of wellhead housing 10. Blind slot 112 extends from the end 114 of ring 100 to a depth whereby the en wall 160 of slot 112 is approximately coplanar with the midportion of frustoconical surface 158 of ring 100. The internal bore of ring 100 includes a smooth, continuous, cylindrical wall surface 157 extending from the bottom 159 of counterbore 144 to the lower terminal end 114 of ring 100. The diameter of internal bore 157 is greater than the outer diameter of sealing surface 60 of casing hanger 22.

Between the radially outermost wall of slot 112 and the outer wall surface 156 of ring body 143, the lower terminal end 114 of ring 100 comprises a downwardly facing, upwardly and inwardly tapering frustoconical annular surface 162. Between the radially innermost wall of slot 112 and the internal bore wall 157 of ring body 143, the lower terminal end 114 of ring 100 comprises a downwardly facing, downwardly and inwardly tapering frustoconical annular surface 164. The annular surfaces 162, 164 are thus "dished" or sloping in opposite directions so that they tend to converge toward the radial midportion of slot 112. Each surface 162, 164 makes an angle of about 5 degrees with the horizontal.

Roller balls 84 which rotatably retain actuation ring 100 on packing ring 82 do not carry any load and are not used for transmitting torque or thrust from packing nut 82 to actuation ring 100. Low-friction bearing rings may be provided between the bottom 159 of counterbore 144 and the lower terminal end of pin 90 to permit sliding engagement therebetween upon energizing sealing means 80 and to transmit thrust from packing nut 82 to actuation ring 100.

Lower actuation ring 104 includes an annular body 166 having a lower end portion comprising a holddown actuator means 168. Holddown actuator means 168 has a downwardly and outwardly facing cam surface 170 adapted for camming engagement with camming head 78 of expandable lock ring 28. When lower actuation ring 104 moves downwardly, cam surface 170 slides downwardly along the correlatively shaped surface of camming head 78 and wedges lock ring 28 outwardly into holddown engagement with groove 14 of wellhead housing 10. Around the interior periphery of the lower end of actuation ring 104 there is disposed a downwardly facing, upwardly and inwardly tapering frustoconical annular surface 172 extending from the lower terminal end 174 of ring 104 to a smooth, cylindrical internal bore wall 176. Bore wall 176 extends upwardly to the upper terminal end 124 of ring 104. The lower terminal end 174 of ring 104 comprises a flat, annular surface. The diameter of internal bore 176 of ring 104 is greater than the outer diameter of sealing surface 60 of casing hanger 22. Extending downwardly from upper end 124, the exterior wall surface of ring body 166 includes a smooth cylindrical upper portion 178, a smooth convex curved middle portion 180 below upper portion 178, and a smooth reduced outer diameter lower cylindrical portion 182 below curved portion 180 and extending to cam surface 170. The outer diameter of upper portion 178 and the maximum outer diameter of curved portion 180 are less than the diameter of internal bore 15 of wellhead housing 10. Blind slot 122 extends from the end 124 of ring 104 to a depth whereby the end wall 184 of slot 122 is at an axial height somewhat above that corresponding to the height midway down curved surface 180.

Between the radially outermost wall of slot 122 and the outer wall surface 178 of ring body 166, the upper terminal end 124 of ring 104 comprises an upwardly facing, downwardly and inwardly tapering frustoconical annular surface 186. Between the radially innermost wall of slot 122 and the internal bore wall 176 of ring body 166, the upper terminal end 124 of ring 104 comprises an upwardly facing, upwardly and inwardly tapering frustoconical annular surface 188. The annular surfaces 186, 188 are thus "dished" or sloping in opposite directions so that they tend to converge toward the radial midportion of slot 122. Each surface 186, 188 makes an angle of about 5 degrees with the horizontal.

Figure 5:
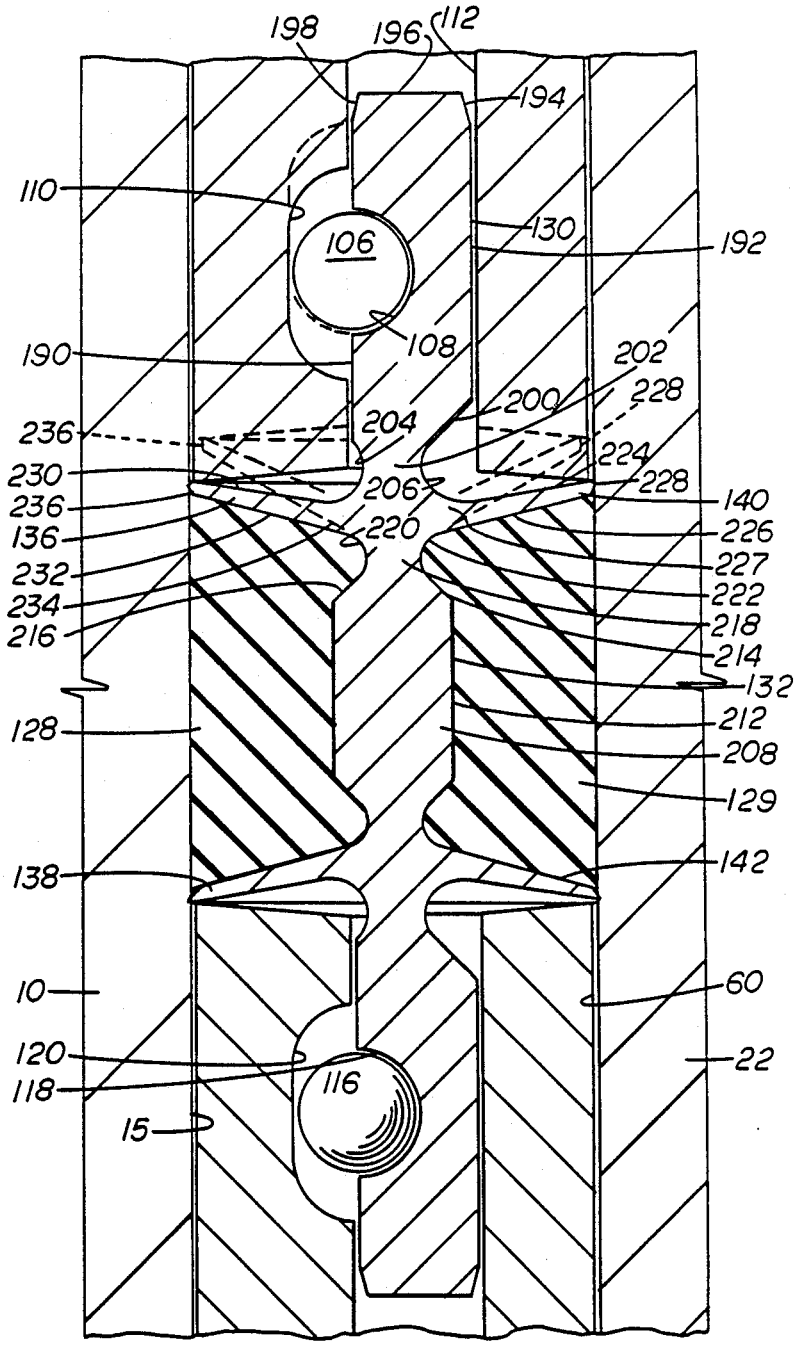
FIG. 5 is a fragmentary, enlarged, vertical or longitudinal cross-sectional view of the sealing member, the lower portion of the upper actuation ring, and the upper portion of the lower actuation ring of the preferred embodiment of the casing hanger packoff assembly of the present invention after the sealing member has been energized, with the respective positions of the same parts of the packoff assembly prior to energization of the sealing member being shown with phantom line outlines.

Referring now to FIG. 5, upper connecting portion 130 of body 126 of sealing member 102 has a generally tubular cylindrical configuration with radially outer and inner wall surfaces 190, 192, respectively. Annular groove 108 is disposed in outer wall 190 and has a diameter slightly larger than that of roller balls 106 retained therein. The radial width of the ball race between grooves 108, 110 is also slightly larger than the diameter of roller balls 106. The radial thickness of upper connecting portion 130 is less than the width of slot 112 so that connecting portion 130 may be freely telescopingly received therewithin. An upwardly and inwardly facing frustoconical surface 194 extends around the upper interior periphery of connecting portion 130 from bore wall 192 to the upper terminal end 196 of connecting portion 130. An upwardly and outwardly facing frustoconical surface 198 extends around the upper exterior periphery of connecting portion 130 from end 196 to outer wall 190. A downwardly and inwardly facing frustoconical surface 200 extends around the lower interior periphery of connecting portion 130 from the lower end of cylindrical inner bore wall 192 to a reduced diameter annular neck 202 extending between upper connecting portion 130 and intermediate seal portion 132 of sealing member 102. Surface 200 may make, for example, an angle of abut 45 degrees with the vertical. Annular neck 202 has a radial thickness less than that of upper connecting portion 130 and includes radially outer and inner concavely curved wall surfaces 204, 206, respectively.

Intermediate seal portion 132 of body 126 of sealing member 102 has a generally tubular cylindrical medial body portion 208 with radially outer and inner wall surfaces 210, 212, respectively. The radial thickness of medial body portion 208 is substantially the same as the radial thickness of upper connecting portion 130, but medial body portion 208 is offset outwardly from upper connecting portion 130. That is, the central longitudinal axis of the segment of medial body portion 208 shown in FIG. 5 is closer to bore wall 15 of housing 10 than is the central longitudinal axis of the illustrated segment of upper connecting portion 130. If, however, ball race 108, 110 were placed on the radially inner periphery of connecting portion 130 and the radially innermost wall of slot 112, the medial body portion 208 preferably would be offset inwardly from upper connecting portion 130. Extending upwardly from the upper end of internal bore wall 212 is an upwardly and inwardly facing frustoconical annular surface 214 which may make, for example, an angle of about 45 degrees with the vertical. A similarly angled, upwardly and outwardly facing frustoconical annular surface 216 extends upwardly from the upper end of exterior wall 210 of medial body portion 208. Surfaces 214, 216 terminate in a reduced diameter annular neck 218 extending between medial body portion 208 and seal lips 136, 140. Annular neck 218 has a radial thickness less than that of medial body portion 208 and about the same as neck 202. Neck 218 includes radially outer and inner concavely curved wall surfaces 220, 222, respectively.

Seal lip 140 flares upwardly and inwardly from body 126 of sealing member 102 between annular necks 202, 218 and includes smooth upper and lower annular surfaces 224, 226, respectively. The axial thickness of seal lip 140 decreases moving from its base 227 toward its radially inner edge 228. For example, lower surface 226 may make an angle of about 60 degrees with the vertical, and upper surface 224 may make an angle of about 65 degrees with the vertical, so that surfaces 224, 226 converge toward one another moving from base 227 to inner edge 228. Prior to energization of sealing means 80, the inner edge 228 of seal lip 140 is substantially flat and vertically disposed, as shown particularly by the phantom line outline of seal lip 140 in FIG. 5. Again as shown in such phantom line outline, the inner diameter of annular seal lip 140 at its edge 228 prior to energization of sealing means 80 is greater than the outer diameter of sealing surface 60 of hanger 22.

Seal lip 136 flares upwardly and outwardly from body 126 of sealing member 102 between annular necks 202, 218 and includes smooth upper and lower annular surfaces 230, 232, respectively. Like seal lip 140, the axial thickness of seal lip 136 decreases moving from its base 234 toward its radially outer edge 236. Again like seal lip 140, lower surface 232 may make an angle of about 60 degrees with the vertical, and upper surface 230 may make an angle of about 65 degrees with the vertical, so that surfaces 230, 232 converge toward one another moving from base 234 of lip 136 to its outer edge 236. Prior to energization of sealing means 80, the outer edge 236 of seal lip 136 is substantially flat and vertically disposed, as shown by the phantom line outline in FIG. 5. The outer diameter of annular seal lip 136 at its edge 236 prior to energization of sealing means 80 is less than the inner diameter of wellhead housing 10 at its internal bore 15, again as shown by the phantom line outline of seal lip 136 in FIG. 5.

Body 126 of sealing member 102 is symmetrical about the transverse central axis through medial body portion 208, and will not be described further herein. Suffice it to say that if FIG. 5 were folded over itself along such transverse central axis, the upper connecting portion 130 would lay substantially precisely over the lower connecting portion 134, groove 108 would match with groove 118, necks 202, 218 would match with their lower counterparts, and seal lips 136, 140 would match with seal lips 138, 142, respectively. The other features and surfaces of body 126 above such transverse axis would likewise have their counterparts below the axis.

Referring to FIGS. 3 and 5, inner elastomeric seal ring 129 is bonded to the interior periphery of body 126 between seal lips 140, 142. Seal ring 129 has a smooth cylindrical internal bore surface 240 which, prior to actuation of sealing means 80, has a diameter greater than the outer diameter of sealing surface 60 of hanger 22, but less than the internal diameter of seal lip 140 at its inner edge 228. An upwardly and inwardly facing annular frustoconical surface 242 is disposed around the upper interior periphery of seal ring 129 adjacent to edge 228 of seal lip 140. Surface 242 may make, for example, an angle of about 15 degrees with the vertical.

Outer elastomeric seal ring 128 is bonded to the exterior periphery of body 126 between seal lips 136, 138. Seal ring 128 has a smooth cylindrical outer wall surface 244 which, prior to actuation of sealing means 80, has an outer diameter less than the diameter of internal bore 15 of housing 10, but greater than the diameter of seal lip 136 at its outer edge 236. An upwardly and outwardly facing annular frustoconical surface 246 is disposed around the upper exterior periphery of seal ring 128 adjacent to edge 236 of seal lip 136. Surface 246 may also make, for example, an angle of about 15 degrees with the vertical.

Like body 126 of sealing member 102, elastomeric seal rings 128, 129 are symmetrical about a transverse central axis through medial body portion 208, so they will not be described further. Elastomeric seal rings 128, 129 may be made of nitrile rubber or other suitable elastomers.

In assembling the packoff assembly 26 of the present invention, lower connecting portion 134 of body 126 of sealing member 102 is inserted into slot 122 of lower actuation ring 104, roller balls 116 are inserted into their raceway through a radially extending port 240 in ring 104 (see FIG. 2), and a plug 242 is soldered into port 240 to seal it. Plug 242 may be soldered in place with silver solder, for example. Upper connecting portion 130 of body 126 is inserted into slot 112 of upper actuation ring 100, roller balls 106 are inserted into their raceway through a radially extending port 244 in ring 100 (FIG. 2), and a plug 246 is soldered into port 244 to seal it, as is plug 242 in port 240. Again with reference to FIG. 2, pin end 90 of packing ring 82 is inserted into counterbore 144, roller balls 84 are inserted into their raceway through another radially extending port 248 in upper actuation ring 100, and a plug 250 is soldered into port 248 like plugs 246, 242 in ports 244, 240, respectively. The packoff assembly 26 can then be telescoped over the upper end of casing hanger 22 and threads 96 of packing nut 82 made up on threads 38 of hanger 22.

Packoff assembly 26 is lowered into the well on casing hanger 22 by a suitable running tool on a string of drill pipe (not shown). Packing nut 82 is only partially threaded onto threads 38 of hanger 22 during the running in operation. Upon landing hanger 22 on top of hanger 48, casing 24 is cemented into place within the borehole. After the cementing operation is completed, the running tool is rotated and torque is transmitted to packoff assembly 26 to actuate it into the holddown position shown in FIG. 1. Torque from the drill string is transmitted to packing nut 82 by means of the castellated upper end of packing nut 82 engaging correlatively shaped portions of the running tool. Packing nut 82 moves downwardly on threads 38 and places an axial load on sealing means 80 causing cam surface 170 of holddown actuator means 168 to move into camming engagement with camming head 78 of lock ring 28. Such camming expands lock ring 28 into wellhead groove 14 for engagement with wellhead housing 10 to hold and lock down casing hanger 22 within housing 10. Sealing means 80 has not yet been energized to seal between surface 60 of hanger 22 and wellhead housing bore 15. The load required for actuating lock ring 28 is substantially less than that required to energize sealing means 80, so sealing means 80 will not be prematurely energized prior to camming the lock ring into groove 14.

In the running in position, the elements 100, 102, and 104 are in an axially snugged-up interfitting relationship. That is, seal lips 136, 140 are abutting at their radially extreme edges 236, 228, respectively, with the radially outer edge of surface 162 and the radially inner edge of surface 164, respectively, of upper actuation ring 100; and seal lips 138, 142 are abutting at their radially extreme edges with the radially outer edge of surface 186 and the radially inner edge of surface 188, respectively, of lower actuation ring 104. As shown in FIG. 3, roller ball 106 is at the lower end of elongate groove 110, and roller ball 116 is at the upper end of elongate groove 120. After lock ring 28 has been actuated into groove 14 of wellhead housing 10, additional torque on packing nut 82 transmits additional thrust to upper actuation ring 100. By this time, lower actuation ring 104 has bottomed out against lock ring 28, see, for example, FIG. 4, and is prevented from moving any further downward. As packing nut 82 continues to move downwardly on threads 38, and as additional thrust is transmitted to upper actuation ring 100, sealing member 102 begins to be compressed between actuation rings 100, 104. Seal lips 136, 140 are forced downwardly by the adjacent surfaces 162, 164 of actuation ring 100. Since the contact between surfaces 162, 164 and seal lips 136, 140, respectively, occurs at upper surfaces 230, 224 near edges 236, 228, respectively, seal lips 136, 140 are rotated downwardly about an axis near the central longitudinal axis of the segment of ring body 126 illustrated in FIG. 5. That is, in cross section, seal lips 136, 140 appear to be pivoted downwardly about such axis. Similarly, surfaces 186, 188 of lower actuation ring 104 force seal lips 138, 142 to be deformed upwardly, toward seal lips 136, 140, respectively. Elastomeric seal members 128, 129 are thus squeezed between seal lips 136, 138 and 140, 142, respectively. As seal rings 128, 129 are so squeezed, the radially outer surface 244 of seal ring 128 expands radially outwardly and sealingly engages surface 15 of wellhead housing 10, and radially inner surface 240 of seal ring 129 contracts radially inwardly and sealingly engages surface 60 of casing hanger 22. The sealing engagement of seal rings 128, 129 with their respective sealing surfaces occurs prior to contact by metal seal lips 136, 138 and 140, 142 with surfaces 15, 60, respectively.

As additional thrust is placed on upper actuation ring 100 by packing nut 82, after sealing engagement of elastomeric seal rings 128, 129, deformation of seal lips 136, 140 in a downward direction continues, as does deformation of seal lips 138, 142 in an upward direction. Pivoting of the metal seal lips about their axes as referred to above causes the radially outer edges of seal lips 136, 138 to eventually contact sealing surface 15, and the radially inner edges of seal lips 140, 142 to contact sealing surface 60 of casing hanger 22, as shown in FIG. 5. Still additional thrust applied through packing nut 82 causes plastic deformation of the radially outer edges of seal lips 136, 138 against bore 15, and plastic deformation of the radially inner edges of seal lips 140, 142 against sealing surface 60. Thus, the extreme edges of seal lips 136, 138 and 140, 142 coin against their respective adjacent sealing surfaces and create a metal-to-metal seal against such surfaces. Coining of the extreme edges of the metal seal lips occurs because ring body 106, including the metal seal lips, is made of a softer metal, such as 316 stainless steel, than the metal used for the wellhead housing 10 and the casing hanger 22. Housing 10 and hanger 22 thus tend to deform elastically as the seal lips 136, 138 and 140, 142 plastically deform against them, respectively.

The sealing means 80 of packoff assembly 26 of the present invention is designed to result in a combined elastomeric and metal-to-metal seal through the application of less than about 15,000 ft.-lbs. of torque, or the equivalent thereof through hydraulic or weight setting, through the drill string and running tool. After application of sufficient torque to energize sealing means 80, sealing member 102 is still free to move upwardly or downwardly between actuation rings 100, 104 due to the roller balls 106, 116 having additional room to move axially in their respective elongate raceway portions 110, 120. Therefore, sealing means 80 may be additionally pressure-energized through the application of fluid pressure from above or below the sealing means, such as would be experienced by the sealing means during testing or in service. Fluid pressure from above, for example, will place an additional downward load on sealing member 102 and will cause it to move incrementally downward, thereby placing additional energizing force on the metal seal lips and elastomeric seal rings 128, 129. Similarly, fluid pressure applied from below sealing means 80 will place an additional upward load on sealing member 102, causing it to move incrementally upward and placing an additional energizing load on the metal seal lips and the elastomeric sealing rings 128, 129. As a result of this pressure-energization effect, considerably less torque may have to be applied to packing nut 82 to result in an effective seal against full working pressures. For example, as little as 1,500 ft.-lbs. of torque, or the equivalent thereof through hydraulic or weight setting, can result in an effective seal against up to about 15,000 psi working pressure. This minimal externally applied setting load establishes a sufficient initial seal against bore wall 15 of housing 10 and sealing surface 60 to prevent pressurized fluids from escaping past the seal and permitting pressure-energization to occur thereafter, up to full working pressure.

An operator may desire to limit the amount of initial externally applied setting load to that which establishes only the elastomeric seals against walls 15, 60 through sealing rings 128, 129, respectively, so that the metal-to-metal seals are not initially established through the seal lips 136, 138 and 140, 142. Thereafter, pressure-energization will occur to an extent which may or may not also establish the metal-to-metal seals, depending upon the magnitude of the load experienced in service. Thus, sealing means 80 of the present invention may act as either an elastomeric seal with metal backup rings, or a combined elastomeric and metal-to-metal seal, depending upon the magnitude of the initial setting load and the amount of pressure-energization which occurs thereafter.

It should be understood that although the present invention has been described particularly with respect to torque setting through packing nut 82, the sealing means 80 may be energized by any other suitable means, such as by hydraulic or weight setting, as mentioned previously in this application. The present invention may be particularly useful with regard to weight setting, since it is a relatively simple task to produce the minimal setting loads as referred to herein which are required to set sealing means 80 through application of appropriate weighting on the drill string.

The rotatable connections between sealing member 102 and actuation rings 100, 104 have a small amount of lateral or transverse and pivoting or rotational play in them, in addition to the ability of these components to move axially to a limited extent with respect to one another, somewhat like the links of a chain, so that if casing hanger 22 were landed slightly off center in the wellhead housing, the sealing means of the present invention will tend to accommodate the misalignment of the casing hanger by transverse or rotational and axial shifting of the components 100, 102, 104. Thus, an effective seal between casing hanger 22 and wellhead housing 15 is assured in spite of the misalignment of the casing hanger with respect to the wellhead housing. Moreover, the rotatable connections between components 100, 102, 104 assure that the sealing means will be set even if the bearing between packing nut 82 and upper actuation ring 100 were to fail. In that event, the packing nut can still be rotated downwardly and advanced on threads 38 with actuation ring 100 rotationally frozen with respect to packing nut 82, since upper actuation ring 100 can rotate with respect to sealing member 102. If it is necessary or desired to retrieve packoff assembly 26 from the well, the substantial, continuous metal link through body 126 of sealing member 102 has sufficient tensile strength, at least 300,000 lbs. and perhaps as high as 400,000 lbs., to ensure that all the components of the packoff assembly may be lifted from the well in one piece.

As shown in FIG. 4, after energization of sealing means 80, there is a void space 252 between upper surface 230 of seal lip 136 and surface 162 of actuation ring 100; there is also a void space 254 between upper surface 224 of seal lip 140 and surface 164 of actuation ring 100. Similarly, there is a void space 256 between the lower surface of seal lip 138 and surface 186 of actuation ring 104; there is also a void space 258 between the lower surface of seal lip 142 and surface 188 of actuation ring 104. In the event that either the outer elastomeric seal ring 128 or the inner elastomeric seal ring 129 reaches its maximum compressibility and cannot be compressed further, and the other elastomeric seal ring requires further compression for full energization, then the seal lips above and below the elastomeric seal ring which will compress no further may deform into the adjacent void spaces 252, 256 or 254, 258, as the case may be, thereby permitting continued movement of actuation rings 100, 104 toward each other to fully energize the other elastomeric seal ring. Thus, both elastomeric seal rings 128, 129 will be fully compressed, even when one fully compresses prior to the other.

Because many varying and different embodiments may be made within the scope of the inventors' concept taught herein, and because many modifications may be made in the embodiments herein detailed, it should be understood that the details set forth herein are to be interpreted as illustrative and not in a limiting sense. Thus, it should be understood that the invention is not restricted to the illustrated and described embodiments, but can be modified within the scope of the following claims.

We claim:

1. A sealing member, comprising:

an integral annular metal body having an upper connecting portion, an intermediate tubular seal portion, and a lower connecting portion;

said intermediate seal portion including a first pair of axially spaced apart, diverging, frustoconical-shaped seal lips around its radially inner periphery and a second pair of axially spaced apart, diverging, frustoconical-shaped seal lips around its radially outer periphery; and an inner elastomeric seal ring disposed on said intermediate seal portion between said seal lips of said first pair and an outer elastomeric seal ring disposed on said intermediate seal portion between said seal lips of said second pair.

2. A sealing member according to claim 1, wherein said seal lips of each of said pairs include an upper and a lower lip which flare away from one another with the upper seal lips of each pair extending radially inward and upward an radially outward and upward and with the lower seal lips of each pair extending radially inward and downward and radially outward and downward.

3. A sealing member according to claim 1, wherein each of said seal lips has a base in said intermediate seal portion and a sealing edge, and wherein said seal lips taper in thickness from their bases to their sealing edges.

4. A sealing member according to claim 3, wherein said sealing lips are substantially parallel to the longitudinal axis of said annular metal body prior to energization of the sealing member.

5. A sealing member according to claim 1, including an upper actuation ring having a depending inner rim and a depending outer rim and being movable with respect to said integral annular metal body, and a lower actuation ring having an upwardly extending inner rim and an upwardly extending outer rim and being movable with respect to said integral annular metal body, said upper actuation ring depending rims being spaced apart a sufficient distance to engage the upper inner and outer sealing lips upon relative downward movement of said upper actuation ring with respect to said intermediate seal portion, said lower actuation ring upwardly extending inner and outer rims being spaced a sufficient distance to engage the lower inner and outer sealing lips upon relative movement of said intermediate seal portion with respect to said lower actuation ring, said seal lips of each of said pairs are adapted to be rotated toward one another upon energization of the sealing member by the movement of said upper and lower actuation rings toward said intermediate seal portion.

6. A sealing member according to claim 5, wherein said first pair of seal lips is adapted to contract the inner diameter of said inner elastomeric seal ring and said second pair of seal lips is adapted to expand the outer diameter of said outer elastomeric seal ring when said seal lips of each of said pairs are rotated toward one another upon energization of the sealing member.

7. A sealing member according to claim 1, wherein the inner diameter of said inner elastomeric seal ring is less than the inner diameters of each of the seal lips of said first pair and the outer diameter of said outer elastomeric seal ring is greater than the outer diameters of each of the seal lips of said second pair.

8. A sealing member according to claim 1, wherein said upper and lower connecting portions each include an annular ball race around their respective peripheries, said upper actuation ring having a ball race on the surface of its depending rim facing the ball race of said upper connecting portion, said lower actuation ring having a ball race on the surface of its upwardly extending rim facing said ball race of said lower connecting portion, a plurality of balls positioned in the registering ball races of said upper connecting portion and said upper actuation ring rim, and a plurality of balls positioned in the registering ball races of said lower connecting portion and said lower actuation ring rim.

9. A sealing member according to claim 8, wherein said annular ball races are disposed on the outer peripheries of said upper and lower connecting portions and said intermediate seal portion is offset outwardly from said connecting portions.

10. A sealing member according to claim 1, wherein said inner elastomeric seal ring is bonded to the inner periphery of said intermediate seal portion and to each of the seal lips of said first pair, and wherein said outer elastomeric seal ring is bonded to the outer periphery of said intermediate seal portion and to each of the seal lips of said second pair.

11. A sealing member according to claim 1, wherein each of said upper and lower connecting portions of said body includes a neck of reduced thickness as compared to the thickness of said connecting portions and said intermediate seal portion of said body by which said connecting portions connect to said intermediate seal portion.

12. A sealing member according to claim 11, wherein said necks have concave curved radially inner and outer walls.

13. A sealing member according to claim 1, wherein said intermediate seal portion includes a medial body portion having a neck on its upper end of reduced thickness with respect to the thickness of said medial body portion and a neck on its lower end of reduced thickness with respect to the thickness of said medial body portion, and each of said first and second pairs of lips includes an upper seal lip and a lower seal lip disposed above and below said necks, respectively.

14. A sealing member according to claim 13, wherein said necks have concave curved radially inner and outer walls.

15. A sealing member according to claim 1, wherein each of said lips has a sealing edge, and wherein upon actuation of said sealing member, said first pair of lips is adapted to move said inner elastomeric seal ring into sealing engagement against one of a pair of opposed circular cylindrical sealing surfaces and to form a metal-to-metal seal against said sealing surface, said second pair of lips is adapted to move said outer elastomeric seal ring into sealing engagement against the other of the pair of sealing surfaces and to form a metal-to-metal seal against that sealing surface, and wherein said elastomeric seals are effected prior to said metal-to-metal seals.

16. A sealing member according to claim 15, wherein said inner elastomeric seal ring has an inner diameter less than that of the first pair of seal lips and the outer elastomeric seal ring has an outer diameter greater than that of said second pair of seal lips.

17. A sealing member according to claim 1, wherein each of said pairs of seal lips includes an upper seal lip and a lower seal lip, and the upper seal lip of each pair flares upwardly and the lower seal lip of each pair flares downwardly;

each of said seal lips has a base in said intermediate seal portion and a sealing edge, said seal lips tapering in thickness from their bases to their sealing edges;

said inner elastomeric seal ring is bonded to the inner periphery of said intermediate seal portion and to said lips of said first pair, and said outer elastomeric seal ring is bonded to the outer periphery of said intermediate seal portion and to said lips of said second pair; and said inner elastomeric seal ring has an inner diameter less than that of the first pair of seal lips and said outer elastomeric seal ring has an outer diameter greater than that of the second pair of seal lips.

18. A sealing member according to claim 17, wherein said sealing edges are substantially parallel to the longitudinal axis of said annular metal body prior to energization of the sealing member.

19. A sealing member according to claim 17, wherein said intermediate seal portion includes a neck below said upper seal lips, another neck above said lower seal lips, and a medial body portion between said necks, said necks having a reduced radial thickness with respect to the thickness of said medial body portion, and wherein said upper connecting portion and said lower connecting portion of said body are integrally attached to said intermediate seal portion through a neck section above said upper seal lips and another neck section below said lower seal lips, respectively, said neck sections having a reduced thickness with respect to the thickness of said upper and lower connecting portions.

20. A sealing member according to claim 1, wherein the strength of said body in tension exceeds 300,000 pounds.

21. A sealing member according to claim 1, wherein said upper and lower connecting portions include means adapted for connecting said sealing member to upper and lower actuation members while permitting relative axial movement between such actuation members and said sealing member.

22. A sealing member, comprising:

an integral annular metal body having an intermediate seal portion;

a first pair of axially spaced apart frustoconical-shaped seal lips around the radially inner periphery of said intermediate seal portion and a second pair of axially spaced apart frustoconical-shaped seal lips around the radially outer periphery of said intermediate seal portion, said pairs of seal lips each including an upper seal lip and a lower seal lip, said upper seal lips flaring upwardly and said lower seal lips flaring downwardly;

an inner elastomeric seal ring disposed on said intermediate seal portion between said seal lips of said first pair and an outer elastomeric seal ring disposed on said intermediate seal portion between said seal lips of said second pair;

said inner seal lips being deformable toward one another into a first sealing position to compress said inner elastomeric seal ring to contract its inner diameter into sealing engagement with one of a pair of opposed cylindrical sealing surfaces, and said outer seal lips being deformable into a first sealing position toward one another to compress said outer elastomeric seal ring to expand its outer diameter into sealing engagement with the other of such pair of cylindrical sealing surfaces.

23. A sealing member according to claim 22, wherein said seal lips are deformable into a second sealing position to establish metal-to-metal sealing engagement with the opposed cylindrical sealing surfaces in addition to sealing engagement of the elastomeric seal rings against such surfaces.

24. A sealing member according to claim 22, wherein said seal lips include sealing edges which are substantially parallel to the longitudinal axis of said intermediate seal portion prior to actuation of said sealing member.

25. A sealing member according to claim 24, wherein said seal lips taper in thickness from said intermediate seal portion to said sealing edges.

26. A sealing member according to claim 22, wherein said inner elastomeric seal ring has an inner diameter less than that of said lips of said first pair and said outer elastomeric seal ring has an outer diameter greater than that of said lips of said second pair.

27. A sealing member according to claim 22, wherein said integral annular metal body further includes an upper connecting portion above said intermediate seal portion and a lower connecting portion above said intermediate seal portion, and including an annular ball race around the periphery of said upper and lower connecting portions.

28. A packoff assembly for sealing between the outer wall of an inner tubular member and the inner wall of an outer tubular member, comprising:

an upper actuation ring;

a sealing member connected to said upper actuation ring, said sealing member including an integral annular metal body, upper and lower seal lip means forming part of said body for forming metal-to-metal seals against each of the walls of the tubular members, and elastomeric seal rings means disposed on said annular metal body between said upper and lower seal lip means for forming elastomeric seals against each of the walls of the tubular members;

a lower actuation ring connected to said sealing member; and said upper and lower actuation rings engaging said seal lip means and including compressing means for energizing said seal lip means and aid elastomeric seal ring means between said seal lip means.

29. A packoff assembly according to claim 28, wherein said compressing means engage said seal lip means and compress said seal lip means into energizing said elastomeric seal ring means prior to being energized into said metal-to-metal seals.

30. A packoff assembly according to claim 28, wherein the connections between said upper actuation ring and said sealing member and between said lower actuation ring and said sealing member are rotatable connections being rotatable with respect to each other about the longitudinal axis of said tubular members.

31. A packoff assembly according to claim 30, wherein the rotatable connection between said upper actuation ring and said sealing member permits limited longitudinal axial movement of said sealing member with respect to said upper actuation ring, and the rotatable connection between said sealing member and said lower actuation ring permits limited relative longitudinal axial movement of said sealing member with respect to said lower actuation rings.

32. A packoff assembly according to claim 31, wherein said rotatable connections permit limited transverse and pivoting movement between said upper actuation ring and said sealing member and between said sealing member and said lower actuation ring.

33. A packoff assembly according to claim 31, wherein said rotatable connections include an annular ball race portion in the upper periphery of said sealing member and an annular ball race portion in the lower periphery of said sealing member, elongate annular ball race portions in said upper actuation ring and in said lower actuation ring, said elongate ball race portions being juxtaposed with said annular ball race portions of said sealing member and forming ball races therewith, and a plurality of roller balls disposed in said ball races.

34. A packoff assembly according to claim 33, wherein said sealing member includes an upper connecting portion and a lower connecting portion and said annular ball race portions are disposed around said upper and lower connecting portions, said upper actuation ring includes an annular blind slot around its lower end in which said upper connecting portion is received and said lower actuation ring includes an annular blind slot around its upper end in which said lower connecting portion is received, said elongate annular ball race portions being disposed in the walls of said blind slots.

35. A packoff assembly according to claim 34, wherein said annular ball race portions of said sealing member are disposed around the exterior periphery of said upper and lower connecting portions, and said elongate annular ball race portions of said upper and lower actuation rings are disposed around the radially outermost walls of said blind slots.

36. A packoff assembly according to claim 35, wherein said sealing member includes an intermediate seal portion between said upper and lower connecting portions and on which said seal lip means and said elastomeric seal ring means are disposed, said intermediate seal portion being offset radially outwardly from said upper and lower connecting portions.

37. A packoff assembly according to claim 34, wherein said annular ball race portions of said sealing member are disposed around the interior periphery of said upper and lower connecting portions, and said elongate annular ball race portions of said upper and lower actuation rings are disposed around the radially innermost walls of said blind slots.

38. A packoff assembly according to claim 37, wherein said sealing member includes an intermediate seal portion between said upper and lower connecting portions and on which said seal lip means and said elastomeric seal ring means are disposed, said intermediate seal portion being offset radially inwardly from said upper and lower connecting portions.

39. A packoff assembly according to claim 28, wherein said sealing member includes an upper connecting portion and a lower connecting portion, said upper actuation ring includes an annular blind slot around its lower end in which said upper connecting portion is received and said lower actuation ring includes an annular blind slot around its upper end in which said lower connecting portion is received, and including means disposed between the walls of said blind slots and said upper and lower connecting portions for connecting said sealing member to said upper and lower actuation rings while permitting limited relative longitudinal axial movement between said actuation rings and said sealing member.

40. A packoff assembly according to claim 39, wherein said seal lip means include inner upper and lower frustoconical-shaped seal lips and outer upper and lower frustoconical-shaped seal lips between said upper and lower connecting portions, said upper seal lips flaring upwardly and said lower seal lips flaring downwardly, and said compressing means includes first inner and outer frustoconical-shaped surfaces on the lower end of said upper actuation ring adjacent its blind slot, said first inner frustoconical-shaped surface engaging said inner upper seal lip and said first outer frustoconical-shaped surface engaging said outer upper seal lip, said compressing means further including second inner and outer frustoconical-shaped surfaces on the upper end of said lower actuation ring adjacent its blind slot, said second inner frustoconical-shaped surface engaging said inner lower seal lip and said second outer frustoconical-shaped surface engaging said outer lower seal lip.

41. A packoff assembly according to claim 40, wherein each of said first and second inner and outer frustoconical-shaped surfaces is sloped in a direction opposite to that of the adjacent respective seal lip.

42. A packoff assembly according to claim 41, wherein each of said first and second inner and outer frustoconical-shaped surfaces makes contact with its adjacent respective seal lip near its sealing edge.

43. A packoff assembly according to claim 42, wherein there is a void space between each of said first and second inner and outer frustoconical-shaped surfaces and the adjacent respective seal lips.

44. A packoff assembly according to claim 40, wherein said elastomeric seal ring means includes an inner elastomeric seal ring disposed between said inner seal lips and an outer elastomeric seal ring disposed between said outer seal lips.

45. A packoff assembly according to claim 28, wherein said lower actuation ring includes means disposed on its lower end adapted for actuating locking means on said inner tubular member into holddown engagement with said outer tubular member.

46. A packoff assembly according to claim 28, and further including a packing nut, and means for rotatably connecting said upper actuation ring to said packing nut.

47. A packoff assembly according to claim 28, wherein the connections between said upper actuation ring and said sealing member and between said lower actuation ring and said sealing member permit limited relative longitudinal axial movement between said actuation rings and said sealing member.

48. A packoff assembly according to claim 47, wherein said connections between said upper actuation ring and said sealing member and between said lower actuation ring and said sealing member permit limited transverse and pivoting movement between said actuation rings and said sealing member.

* * * * *